US005557376A

United States Patent [19]

Landa et al.

[11] Patent Number: 5,557,376

[45] Date of Patent: Sep. 17, 1996

[54] COLOR IMAGING SYSTEM

[75] Inventors: Benzion Landa, Edmonton, Canada; Ishaiau Lior, Nes Ziona, Israel; Dan Barnea, Neve Monosson, Israel; Paul Fenster, Petach Tikva, Israel; Uri Levy, Rehovot, Israel

[73] Assignee: Indigo N.V., Maastricht, Netherlands

[21] Appl. No.: 351,546

[22] Filed: May 15, 1989

[51] Int. Cl.[6] ..... G03G 15/10; G03G 15/01

[52] U.S. Cl. ..... 355/256; 118/645; 118/659

[58] Field of Search ..... 355/256, 298; 354/318, 325; 118/645, 659, 660, 661; 239/549

[56] References Cited

U.S. PATENT DOCUMENTS

| | | | |
|---|---|---|---|
| 2,501,724 | 3/1950 | Hughey | 239/549 |
| 2,685,916 | 8/1954 | Martt | 239/549 |
| 3,405,683 | 10/1968 | Jons et al. | 118/659 |
| 3,687,708 | 8/1972 | Miller | 355/256 X |
| 3,701,337 | 10/1972 | Borelli et al. | 118/652 |
| 3,806,355 | 4/1974 | Kaufman | 355/256 X |
| 3,900,003 | 8/1975 | Sato et al. | 355/256 X |
| 3,910,231 | 10/1975 | Inoue et al. | 118/652 X |
| 3,921,580 | 11/1975 | Kase | 118/651 |
| 3,965,861 | 6/1976 | Fukushima et al. | 118/661 X |
| 4,073,266 | 2/1978 | Arneth et al. | 118/661 X |
| 4,233,385 | 11/1980 | Hinz et al. | 118/659 X |
| 4,286,039 | 8/1981 | Landa et al. | 118/661 X |
| 4,342,823 | 8/1982 | Grant et al. | 355/256 X |
| 4,400,079 | 8/1983 | Landa | 355/256 |
| 4,439,035 | 3/1984 | Landa | 355/307 |
| 4,504,138 | 3/1985 | Kuehnle et al. | 355/256 |
| 4,522,484 | 6/1985 | Landa | 355/256 |
| 4,690,539 | 9/1987 | Radulski et al. | 355/256 X |
| 4,794,651 | 12/1988 | Landa et al. | 430/110 |
| 4,799,452 | 1/1989 | Day | 118/645 |

FOREIGN PATENT DOCUMENTS

| | | |
|---|---|---|
| 55-142662 | 11/1980 | Japan . |
| 58-2863 | 1/1983 | Japan . |
| 8700916 | 2/1987 | WIPO . |

OTHER PUBLICATIONS

English abstract of Japanese publication No. 58–2863.

International Search Report carried out by the European Patent Office. (and annex).

*Primary Examiner*—Joan H. Pendegrass

*Attorney, Agent, or Firm*—Greenblum & Bernstein P.L.C.

[57] ABSTRACT

A multicolor electrostatic imaging system includes an electrostatic imaging surface, apparatus for supplying an electrostatic image on the electrostatic image surface, and multicolor supply apparatus for supplying a liquid toner of a selectable color to the electrostatic imaging surface. The supply apparatus has a multiplicity of jet outlets, including a set of jet outlets for supplying toner of the selectable color directly to the imaging surface, the set of jet outlets being distributed among the multiplicity of jet outlets. Finally, developing apparatus is provided for developing the electrostatic image using the liquid toner, and transfer apparatus is provided for transferring the developed image to a substrate.

30 Claims, 7 Drawing Sheets

COLOR IMAGING SYSTEM

FIELD OF THE INVENTION

The present invention relates generally to multicolor imaging.

BACKGROUND OF THE INVENTION

Proposals for various types of multicolor imaging apparatus and techniques appear in the patent literature. There is described in Japanese Patent document 58002863 to Kawamura an image recording device for use in a color printer which include nozzle heads which spray liquid coloring toner onto electrostatic latent images on the side of a photosensitive drum and thus develop images thereon. A single nozzle is provided for each color and the nozzles reciprocate along a nozzle guide. Alternating current apparatus is disposed between the nozzle and the drum in order to spread out the impingement area of the toner on the drum.

U.S. Pat. No. 4,690,539 describes transfer apparatus in which a plurality of liquid images are transferred from a photoconductive member to a copy sheet. A liquid image, which includes a liquid carrier having toner particles dispersed therein, is attracted from the photoconductive member to an intermediate web. A substantially amount of the liquid carrier is removed from the intermediate web and the toner particles are secured thereon. Thereafter, another liquid image having toner particles of a different color from the toner particles of the first liquid image is attracted to the intermediate member. Once again the liquid carrier material is removed from the web and the toner particles of the second liquid image are secured thereon. Thereafter, all of the toner particles are transferred from the intermediate member to the copy sheet, in image configuration.

U.S. Pat. No. 3,900,003 describes a liquid developing device for use in multicolor electrophotographic copying machines, having a plurality of feed pipes for supplying different liquid color developers to a developing station, which feed pipes are connected to a common developer supply pipe. Valves are provided in the feed pipes wherein each of the valves are actuated by an electrical signal to supply only a selected liquid color developer to a developing station at a time. The liquid developing device is also provided with a belt for removing residual liquid developer remaining on an image bearing member after development and with a plurality of blades for scraping and collecting the thus removed liquid developer, which are actuated in correspondence with a selected color.

U.S. Pat. No. 4,504,138 describes a method and apparatus for developing electrostatic latent images formed on a photoconductor surface comprising the steps of applying a thin viscous layer of electrically charged toner particles to an applicator roller preferably by electrically assisted separation thereof from a liquid toner suspension, defining a restricted passage between the applicator roller and the photoconductor surface which approximates the thickness of the viscous layer and transferring the toner particles from the applicator roller to the photoconductor surface due to the preferential adherence thereof to the photoconductor surface under the dominant influence of the electric field strength of the electrostatic latent image carried by the photoconductive surface.

U.S. Pat. No. 4,400,079 describes a developing system for an electrophotographic copier in which a roller having a conductive outer surface is disposed adjacent to the imaging surface to form a gap. The roller is driven at a peripheral linear velocity substantially greater than the velocity of movement of the imaging surface and is supplied with liquid developer at a location spaced from the gap to cause the roller to inject the developer into the gap. The roller is coupled to a source of electrical potential.

U.S. Pat. No. 4,342,823 describes a perforate development electrode and a method for developing electrostatic images directly on a final image bearing sheet, formed of electrophotographic material coated onto a substrate, by means of a perforate development electrode and liquid toner, without immersing the material in a bath of toner. The method comprises spraying liquid toner against pressure reducing means adjacent to the electrode to reduce and make uniform the pressure of the flowing liquid toner and flowing the liquid toner uniformly over and through the perforate development electrode and over the image side of the sheet without contacting the side opposite the image side with the toner.

U.S. Pat. No. 4,233,385 describes a method of liquid development of charge images formed on a surface of a tape-like record carrier, for example by an electrostatic printer. The record carrier is simultaneously sprayed with developer liquid in two flows which are directed towards each other. As a result two separate, uniform and oppositely directed flow zones meeting at one common turbulent flow zone are obtained. Both during pre-development and final development the charge images are brought into contact with a large quantity of fresh developer liquid.

U.S. Pat. No. 4,073,266 describes apparatus for developing a latent electrostatic image on an electrophotographic copying material by means of a toner dispersion. An infeed roller applies the toner dispersion to the copying material and downstream thereof, a distribution roller acts on the surface of the copying material. Squeegee rollers downstream of the distribution roller effect removal of unused toner. Toner which adheres to the distribution roller during application of voltage thereto is sprayed off and recovered for recycling, the spraying agent being toner dispersion.

U.S. Pat. No. 3,405,683 describes apparatus for the development of latent electrostatic images on an electrophotographic material with a liquid developer which includes means to feed the electrophotographic material through a pair of rotatable nip rolls and nozzle means adapted to simultaneously spray the electrostatic image and the nip roll which contacts the latent image.

SUMMARY OF THE INVENTION

It is a particular feature of the present invention that a highly efficient, simple and relatively low cost "instant" color change multicolor electrostatic imaging system is provided.

There is thus provided in accordance with a preferred embodiment of the present invention a multicolor electrostatic imaging system comprising an electrostatic imaging surface, means for applying an electrostatic image to the electrostatic image surface, multicolor spray means for supplying a liquid toner of a selectable color to the electrostatic imaging surface, the spray means comprising a multiplicity of spray outlets including a plurality of spray outlets, distributed among the multiplicity of spray outlets, for supplying liquid toner of each of a plurality of colors, developing means for developing the electrostatic image using the liquid toner, and means for transferring the developed image to a substrate.

Further in accordance with a preferred embodiment of the present invention, the multicolor electrostatic imaging system comprises an electrostatic imaging surface, means for applying an electrostatic image to the electrostatic image surface, multicolor spray means for supplying a liquid toner of a selectable color to the electrostatic imaging surface, developing means for developing the electrostatic image using the liquid toner, the developing means comprising a plurality of single color cleaning assemblies engaging a developing electrode, each cleaning assembly corresponding to a given one of a plurality of colors, and means for transferring the developed image to a substrate.

Further in accordance with a preferred embodiment of the present invention, the multicolor electrostatic imaging system comprises an electrostatic imaging surface, means for applying an electrostatic image to the electrostatic image surface, multicolor spray means for supplying a liquid toner of a selectable color to the electrostatic imaging surface, developing means for developing the electrostatic image using the liquid toner, means for transferring the developed image to a substrate, and means for recycling excess liquid toner to the multicolor spray means.

Further in accordance with a preferred embodiment of the present invention, the electrostatic imaging system comprises an electrostatic imaging surface, means for applying an electrostatic image to the electrostatic image surface, spray means for spraying a liquid toner into engagement with a generally downward facing portion of the electrostatic imaging surface, developing means for developing the electrostatic image using the liquid toner, and means for transferring the developed image to a substrate.

Additionally in accordance with a preferred embodiment of the present invention, the spray means comprises means for directing a spray of liquid toner in a direction having an upward component.

Further in accordance with a preferred embodiment of the present invention, the spray means comprises means for directing a spray of liquid toner onto a downward facing surface of the electrostatic imaging surface.

Additionally in accordance with a preferred embodiment of the present invention, the electrostatic imaging surface comprises a cylindrical surface.

Still further in accordance with a preferred embodiment of the present invention, the spray means comprises means for directing a spray of liquid toner onto at least part of the lower hemisphere of the cylindrical surface.

Further in accordance with a preferred embodiment of the present invention, the spray means comprises a linear array of spray outlets.

Additionally in accordance with a preferred embodiment of the present invention, the multiplicity of spray outlets include interdigitated spray outlets for liquid toner of differing colors.

Still further in accordance with a preferred embodiment of the present invention, the developing means comprises a rotating cylindrical developing electrode.

Further in accordance with a preferred embodiment of the present invention, the electrostatic imaging surface moves in a first direction and the surface of the rotating cylindrical developing electrode moves in adjacent spaced relationship thereto in a second direction opposite to the first direction.

Additionally in accordance with a preferred embodiment of the present invention, the developing means comprises a plurality of single color cleaning assemblies, each corresponding to a given one of a plurality of colors.

Still further in accordance with a preferred embodiment of the present invention, the developing means comprises a final cleaning assembly, downstream of the plurality of cleaning assemblies.

Further in accordance with a preferred embodiment of the present invention, the system also comprises single color toner receiving means associated with at least one of the single color cleaning assemblies.

Still further in accordance with a preferred embodiment of the present invention, the system also comprises means communicating with the single color toner receiving means for recycling single color toner to the spray means.

Further in accordance with a preferred embodiment of the present invention, the developing means comprises a rotating cylindrical developing electrode and the single color cleaning assemblies include means for selectably engaging the developing electrode.

Still further in accordance with a preferred embodiment of the present invention, the cleaning assemblies include scraper blade means.

Additionally in accordance with a preferred embodiment of the present invention, the system also comprises a squeegee cooperating with the image bearing surface downstream of the developing means for removal of excess liquid.

Further in accordance with a preferred embodiment of the present invention, the electrostatic image comprises image regions maintained at a first electrical potential and wherein the squeegee is maintained at a voltage having a sign opposite to the sign of the first electrical potential.

Still further in accordance with a preferred embodiment of the present invention, the electrostatic imaging surface moves in a first direction with a first velocity and the surface of the squeegee moves in touching relationship thereto in the first direction at the first velocity.

Additionally in accordance with a preferred embodiment of the present invention, the system also comprises separator means for separating toner particles from dispersant.

Still further in accordance with a preferred embodiment of the present invention, the separator means receives toner from at least one of the following sources: the developer means, means for removing excess liquid from the image bearing surface prior to transfer of the developed image from the image bearing surface, and means for cleaning the image bearing surface after transfer of the developed image from the image bearing surface.

Additionally in accordance with a preferred embodiment of the present invention, the system also comprises means for supplying clean dispersant produced by the separator means to the means for cleaning to aid in removal of residual toner from the image bearing surface.

Further in accordance with a preferred embodiment of the present invention, the means for transferring comprises an intermediate transfer member which is operative sequentially to receive a plurality of developed images from the image bearing surface before transferring them to the substrate.

Still further in accordance with a preferred embodiment of the present invention, the multicolor spray means comprise a manifold formed of a stack of individual outlet defining members, which stack defines separate toner supply conduits corresponding to each of the plurality of colors.

Additionally in accordance with a preferred embodiment of the present invention, the stack also comprises a multiplicity of separator members, each pair of adjacent outlet defining members being separated by a separator member, which seals the outlets defined by adjacent outlet defining members from each other.

Still further in accordance with a preferred embodiment of the present invention, the stack comprises a repeating series of outlet defining members corresponding to different colors.

Additionally in accordance with a preferred embodiment of the present invention, the spray means includes means operative to provide a plurality of jets of toner whose cross sectional extent upon impingement with the electrostatic imaging surface does not significantly exceed the cross sectional extent thereof upon leaving the spray means.

Further in accordance with a preferred embodiment of the present invention there is provided an electrostatic imaging system with a generally cylindrical electrostatic imaging surface rotating in a first sense, means for applying an electrostatic image to said electrostatic image surface, supply apparatus for supplying a liquid toner to the electrostatic imaging surface, and developing apparatus for developing said electrostatic image using said liquid toner, comprising a roller in spaced relationship with the image surface and rotating in the first sense.

BRIEF DESCRIPTION OF THE DRAWINGS

The present invention will be understood and appreciated from the following detailed detailed description, taken in conjunction with the drawings in which.

DETAILED DESCRIPTION OF PREFERRED EMBODIMENTS

Figure 1:
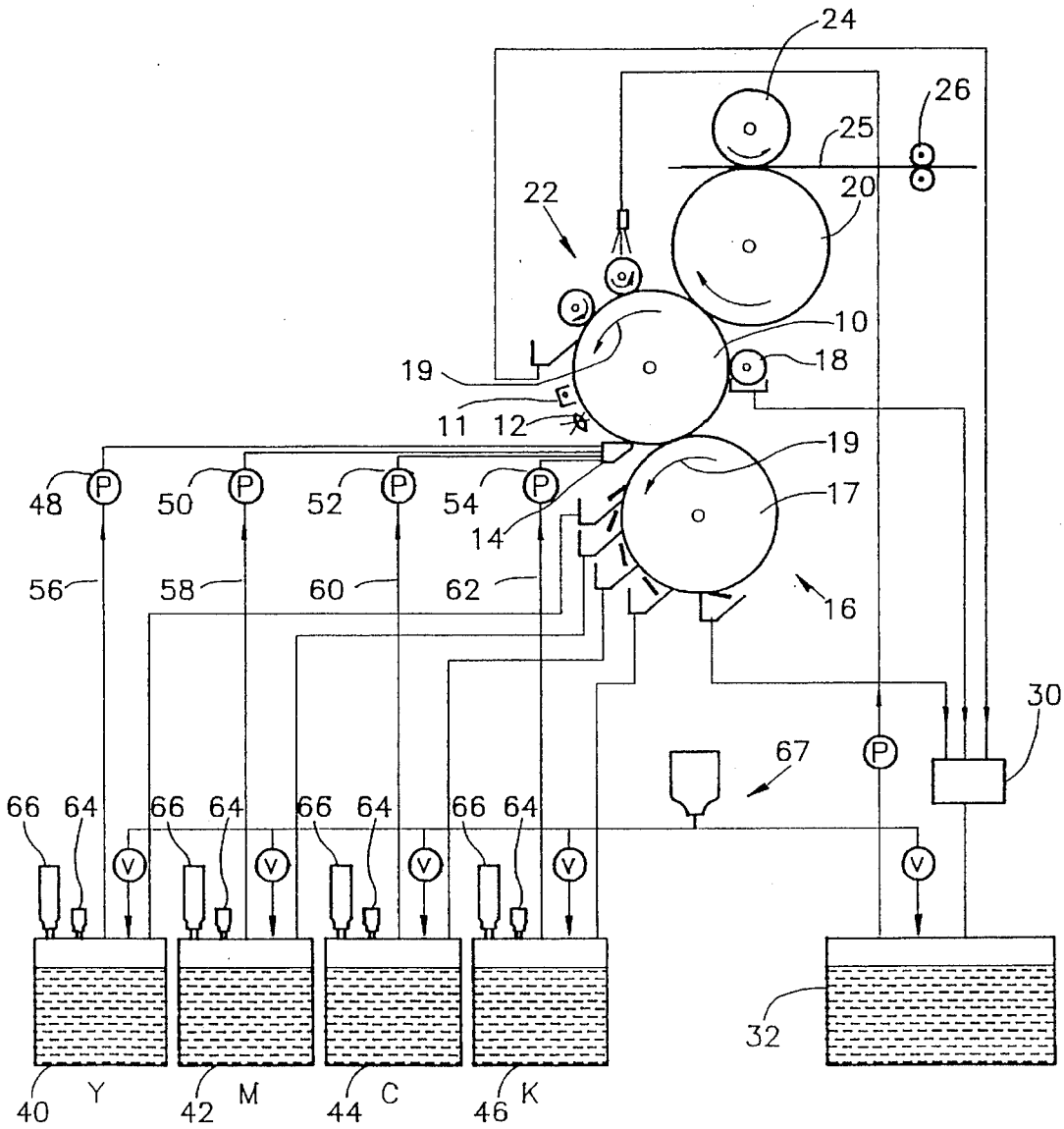
FIG. 1 is a generalized schematic illustration of an imaging system constructed and operative in accordance with a preferred embodiment of the present invention.

Reference is now made to FIG. 1 which illustrates a multicolor electrostatic imaging system constructed and operative in accordance with a preferred embodiment of the present invention. As seen in FIG. 1 there is provided an image bearing surface typically embodied in a rotating photoconductive drum 10. Operatively associated with the photoconductive drum 10 is photoconductor charging apparatus 11 and imaging apparatus 12, for providing a desired latent image on drum 10. The latent image normally comprises image areas at a first electrical potential and background areas at another electrical potential.

Also associated with the photoconductive drum 10 are a multicolor toner spray assembly 14, a developing assembly 16, an excess liquid removal assembly 18, an intermediate transfer member 20 and a cleaning station 22. It is a particular feature of a preferred embodiment the present invention that the spray assembly 14 sprays onto a downward facing portion of the photoconductor drum 10. The spray may be upward or with an upward directional component, as shown. For other embodiments of the invention the spray direction may be horizontal or it may have a downward component. It is a further particular feature of a preferred embodiment of the invention that the spray assembly 14 is operative to provide a plurality of jets of toner whose cross sectional extent upon impingement with the drum does not significantly exceed the cross sectional opening of each spray nozzle.

The developing assembly 16 preferably comprises a developer drum 17 spaced from the phtoconductive drum 10 and typically rotating in the same sense as drum 10, indicated by arrows 19.

The drum 10, the photoconductor charging apparatus and the imaging apparatus 12 may be any suitable drum and imaging apparatus such as are well known in the art. The developing assembly 16 is of unique construction which will be described in detail hereinbelow. The excess liquid removal assembly 18 typically comprises a charged squeegee roller as described in U.S. Pat. No. 4,286,039, the disclosure of which is hereby incorporated by reference herein.

The intermediate transfer member 20 may be any suitable intermediate transfer member such as those described in U.S. patent application Ser. No. 306,062 filed Feb. 6, 1989, now U.S. Pat. No. 4,999,677, the disclosure of which is hereby incorporated by reference herein, and is arranged for electrostatic transfer of the image from the image bearing surface to the intermediate transfer member. The intermediate transfer member 20 is associated with a pressure roller 24 for transfer of the image onto a further substrate 25, such as paper, preferably by heat and pressure. A fuser 26 may be associated with the substrate 25, for fixing the image thereon if required. Cleaning station 22 may be any suitable cleaning station, such as that described in U.S. Pat. No. 4,439,035, the disclosure of which is hereby incorporated by reference herein.

In accordance with a preferred embodiment of the invention, after developing each image in a given color, the image is transferred to the intermediate transfer member 20. Subsequent images in different colors are built up onto the intermediate transfer member 20 and when all of the desired images have been transferred thereto, the transfer member 20 transfers the composite image to substrate 25. Pressure roller 24 therefore only produces operative engagement between intermediate transfer member 20 and substrate 25 when transfer of the composite image to the substate 25 takes place. Alternatively, the image may be transfered to the paper after formation each color image. In this case the paper will have to be fed through the machine once for each color.

According to a preferred embodiment of the invention, excess liquid containing toner particles of various colors is collected from the cleaning station 22, the excess liquid removal assembly 18 and the developer assembly 16 and supplied to a separator 30 which is operative to separate relatively clean dispersant from the various colored toner particles. The separator may typically be of the type described in U.S. patent application Ser. No. 319,124, filed Mar. 6, 1989, the disclosure of which is hereby incorporated by reference herein. The clean dispersant is supplied from separator 30 to a dispersant reservoir 32 which also may receive additional supplies of dispersant, as necessary. Dispersant from reservoir 32 is supplied to cleaning station 22.

Figure 2:
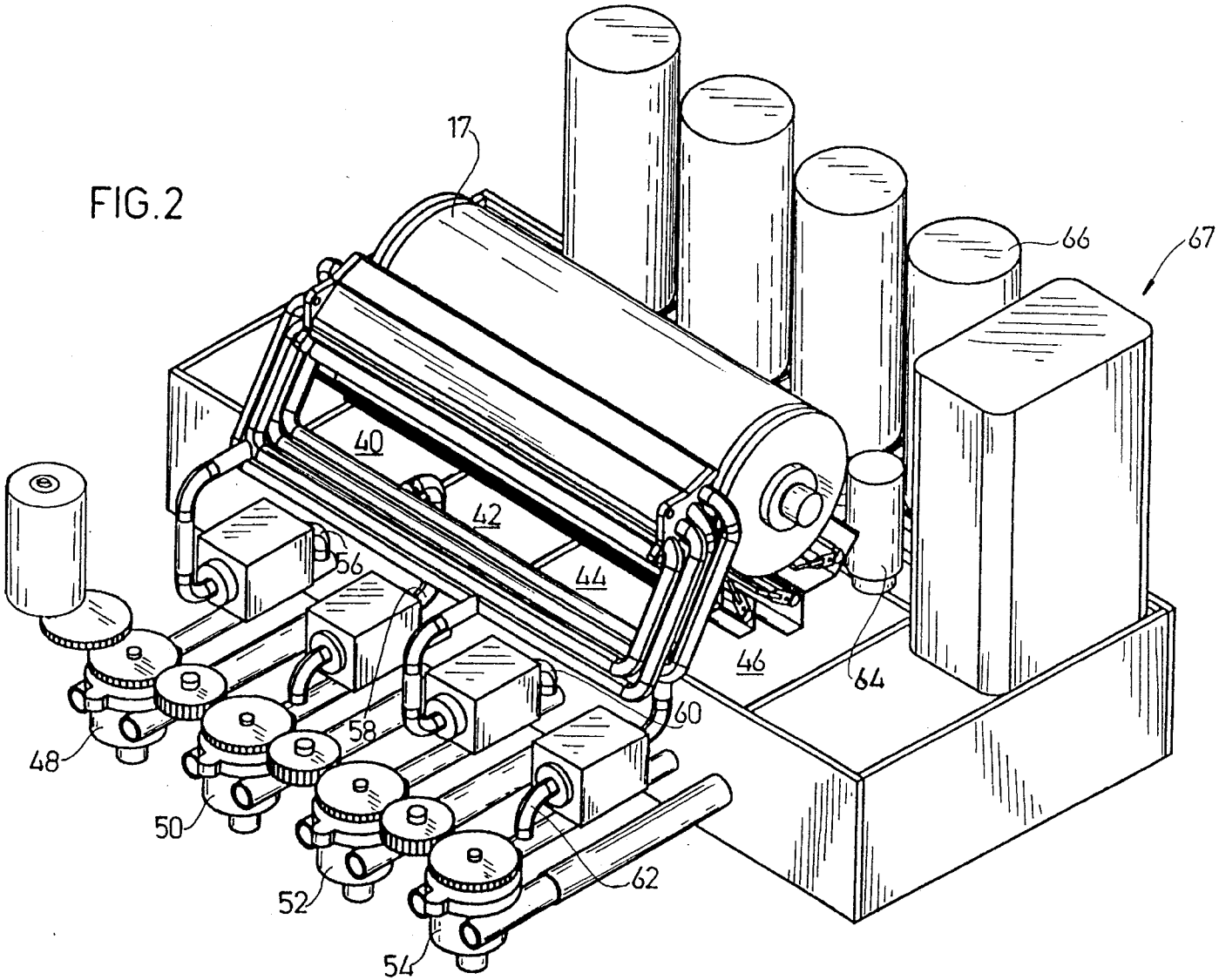
FIG. 2 is a pictorial illustration of a portion of the apparatus of FIG. 1.

Reference is now made additionally to FIG. 2, which is a pictorial illustration of part of the apparatus of FIG. 1, not including photoconductive drum 10, intermediate transfer member 20, roller 24, substrate 25 and fuser 26. It is seen in FIGS. 1 and 2 that the multicolor toner spray assembly 14 receives separate supplies of colored toner from four different reservoirs 40, 42, 44 and 46, typically containing the colors Yellow, Magenta, Cyan and Black respectively. Pumps 48, 50, 52 and 54 may be provided along respective supply conduits 56, 58, 60 and 62 for providing a desired amount of pressure to the colored toner.

Associated with each of reservoirs 40, 42, 44 and 46 are typically provided containers of charge director and concentrated toner material, indicated respectively by reference numerals 64 and 66 as well as a supply of carrier liquid, indicated generally by reference numeral 67.

Each of the reservoirs 40, 42, 44 and 46 also typically receives an input of recycled toner of a corresponding color from developer assembly 16, which will be described hereinbelow in greater detail.

Figure 3:
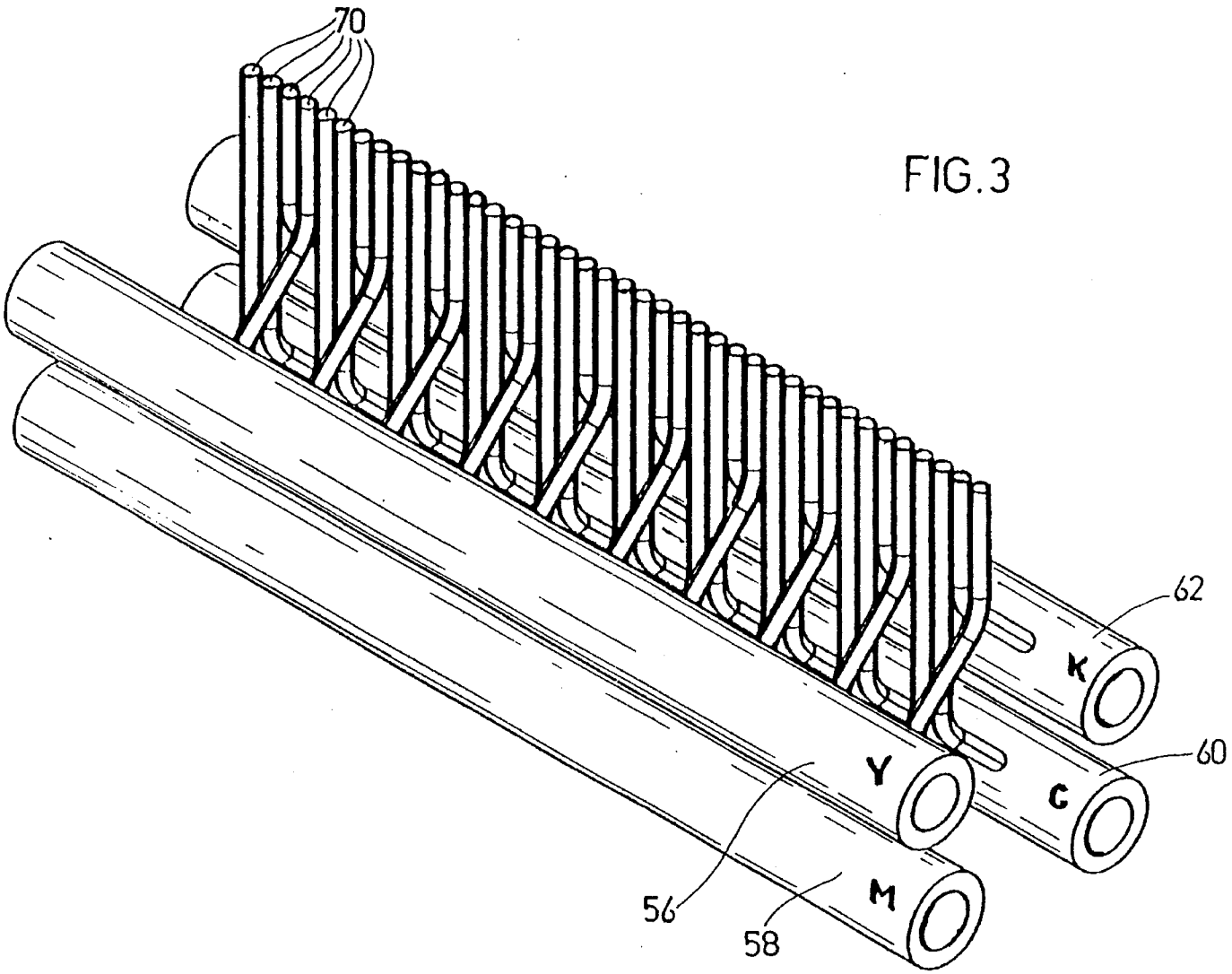
FIG. 3 is a pictorial illustration of one embodiment of spray apparatus employed in the present invention.
Figure 4A:
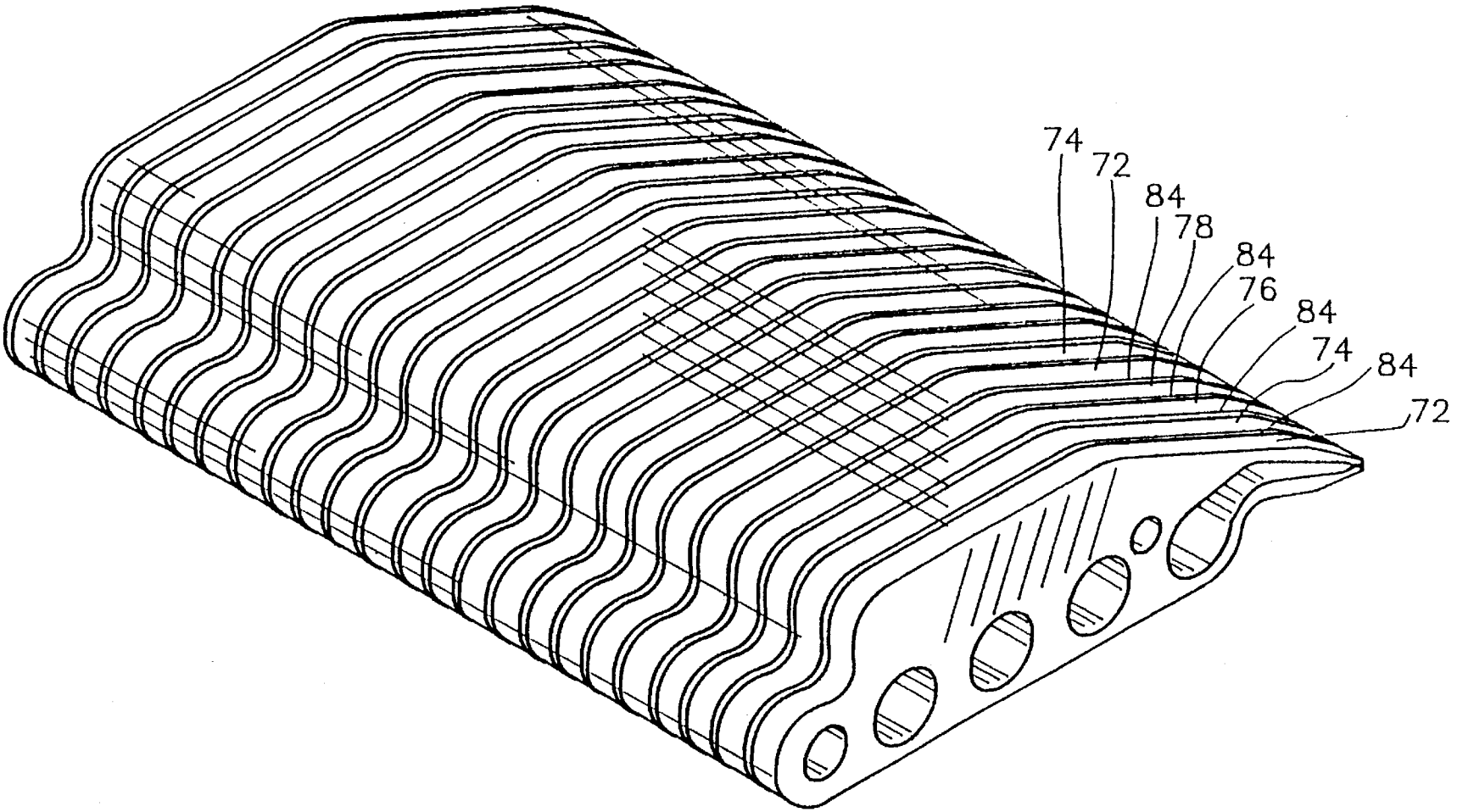
FIGS. 4A and 4B are respective pictorial and partially sectional illustrations of a preferred embodiment of spray apparatus employed in the present invention.
Figure 4B:
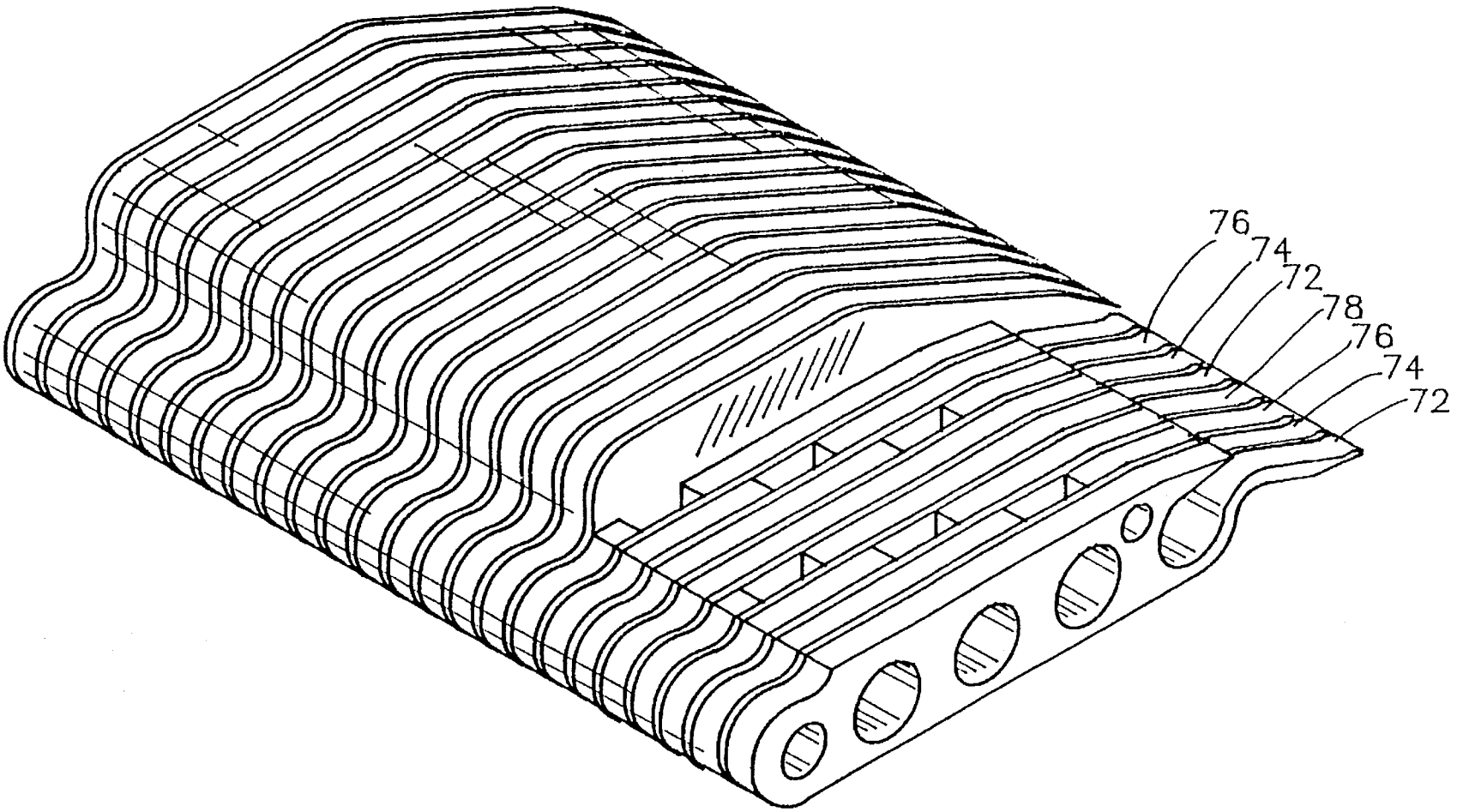

Reference is now made to FIG. 3 which illustrates one embodiment of a multicolor toner spray assembly. In the embodiment of FIG. 3 it is seen that there is provided a linear array of spray outlets 70, each of which communicates with one of the four conduits 56, 58, 60 and 62. The spray outlets are preferably interdigitated such that every fourth outlet is of the same color and that every group of four adjacent outlets includes outlets of four different colors. The spacing of the spray outlets and their periodicity is selected to enable substantially complete coverage of the photoconductor to be realized for each given color separately. Preferably the center to center spacing of the outlets should be as small as possible. In the embodiment of FIG. 3, the center to center spacing is typically 2 mm. The nozzle openings of the outlets are restricted to provide a desired flow configuration and preferably have a generally rectangular cross section. In any event, the amount of toner that is applied to the drum in accordance with the present invention is sufficient to provide a layer of toner of thickness at least sufficient to substantially fill the gap between the drum 10 and the developer drum 17.

Reference is now made to FIGS. 4A and 4B and FIGS. 5A–5E, which together illustrate a preferred embodiment of spray assembly which is composed of a predetermined sequence of modular elements arranged in a stack and tightly held together. It may be appreciated from a consideration of FIGS. 5A–5E, that each of the modular elements illustrated therein defines a part of four conduits corresponding to conduits 56, 58, 60 and 62 as well as two apertures 80 and 82 for accommodating connection and tightening bolts (not shown) which hold the spray assembly 14 together.

Figure 5A:
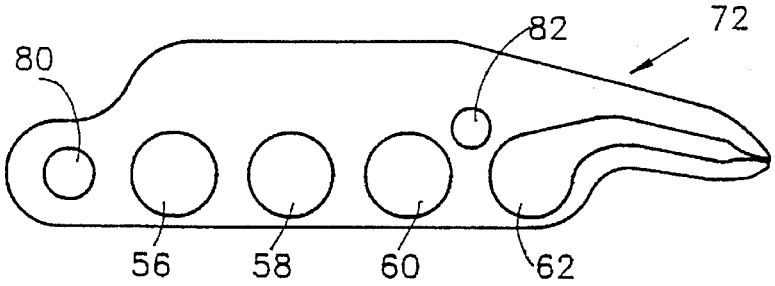
FIGS. 5A, 5B, 5C, 5D and 5E are sectional illustrations of modular sections of the spray apparatus of FIG. 4.
Figure 5B:
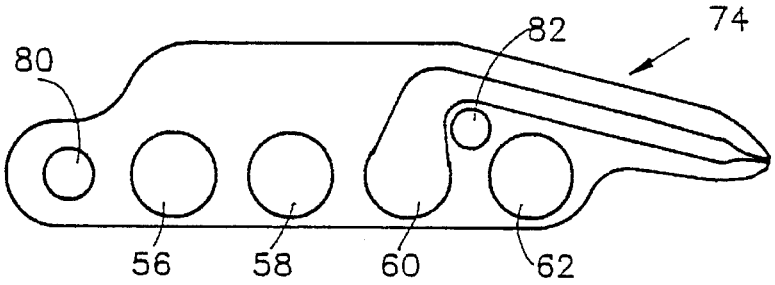
Figure 5C:
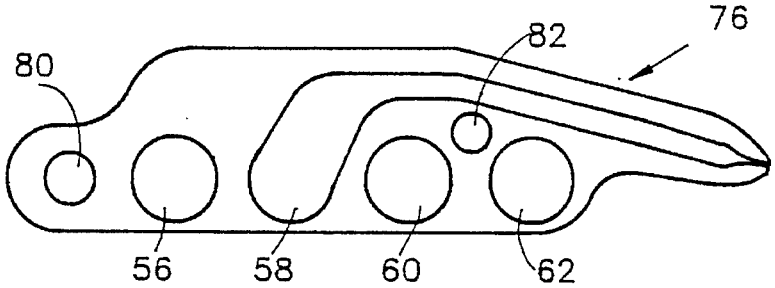
Figure 5D:
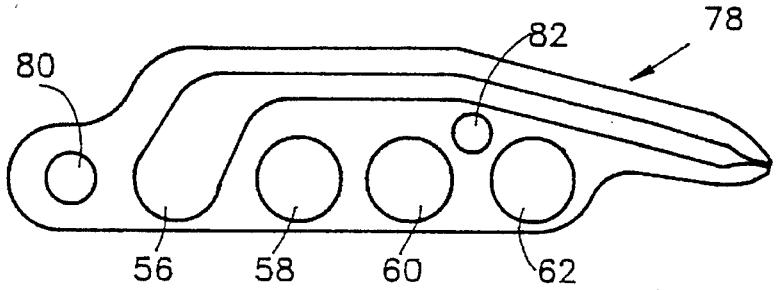
Figure 5E:
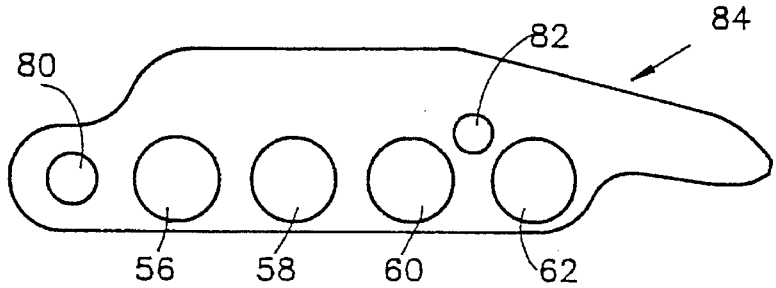

It may be appreciated that the modular element 72 illustrated in FIG. 5A corresponds to a spray outlet communicating with conduit 62, while the modular element 74 illustrated in FIG. 5B corresponds to a spray outlet communicating with conduit 60. The modular element 76 illustrated in FIG. 5C corresponds to a spray outlet communicating with conduit 58, while the modular element 78 illustrated in FIG. 5D corresponds to a spray outlet communicating with conduit 56.

Modular elements 72, 74, 76 and 78 are each typically of thickness 1 mm. This thickness defines one generally rectangular dimension of each spray outlet, whose other dimension is normally selected to provide a desired application of toner to the drum 10 as described hereinabove.

Disposed in sealing engagement between each of the adjacent modular elements illustrated in FIGS. 5A–5D is a spacer element 84 (FIG. 5E), typically much thinner than the remaining modular elements, which seals the various spray outlets from each other and prevents color contamination. Spacer elements 84 typically have a thickness of 0.1 mm. It is a particular feature of the embodiment of FIGS. 4A–5E that relatively small spatial separations between adjacent spray outlets may be realized. For the typical dimensions mentioned above, the center to center spacing between adjacent outlets for the same color is 4.4 mm, while in the embodiment of FIG. 3, the corersponding spacing is 8 mm. This close spacing enhances the uniformity of the toner film on the drum 10 when it operatively engages the developer drum 17.

Figure 6:
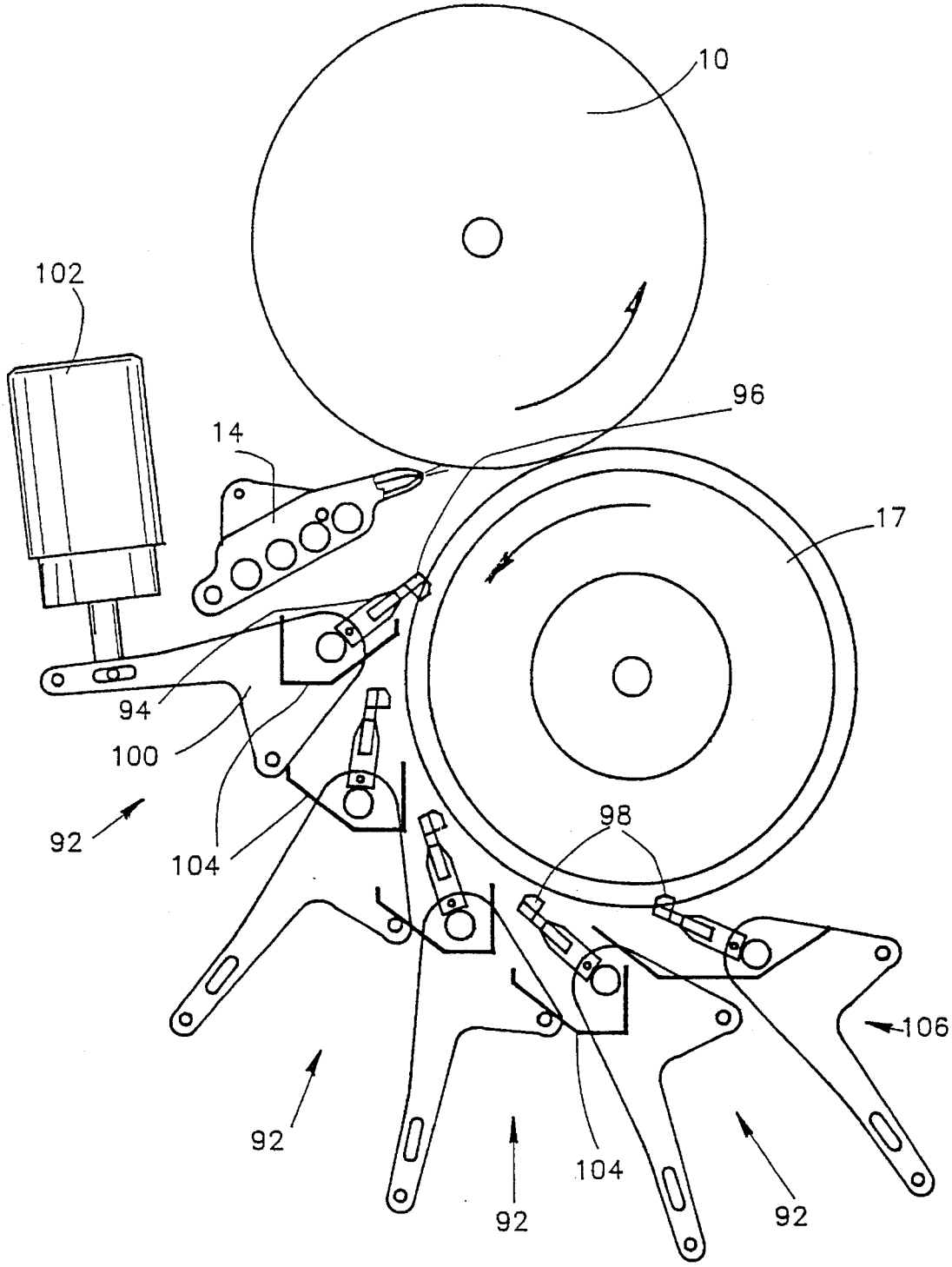
FIG. 6 is a sectional illustration of part of the apparatus of FIG. 1 which particularly illustrates a multicolor, non-contaminating developer assembly particularly useful in the present invention.

Reference is now made to FIG. 6 which illustrates a developer assembly constructed and operative in accordance with a preferred embodiment of the invention. The developer assembly comprises developer drum 17 which operatively engages the photoconductor drum 10 in spaced relationship therewith and, due to its rotation in the same sense as photoconductor drum 10, acts as a metering device. Developer drum 17 is maintained at an voltage, typically +200 Volts when the voltage of the image areas of the photoconductor 10 is approximately +1000. Volts and the voltage on the background areas of the photoconductor 10 is approximately +100 Volts. The above voltages are typical for the use of negatively charged toner and a selenium coated photoconductor drum. If it is desired to use a positively charged toner or another type of photoconductor material, correspondingly different voltages will be appropriate.

A preferred type of toner for use with the present invention is that described in Example 1 of U.S. Pat. No. 4,794,651, the teachings of which are incorporated herein by reference. Other toners may alternatively be employed.

Operatively associated with developer drum 17 are a plurality of color specific toner cleaning assemblies 92, each of which is selectably brought into operative association with the developer electrode 90 only when toner of a color corresponding thereto is supplied to the photoconductor 10 by spray apparatus 14.

Each of cleaning assemblies 92 comprises a blade member 94 including a main portion 96 and side wiping portions 98 arranged to engage the two edges of the electrode drum surface. The blade member 94 is mounted on a linkage 100 which is selectably positioned by a conventional actuator 102. Associated with each of the cleaning assemblies 92 is a toner collection member 104 which serves to collect the toner removed by the cleaning assembly 92 from the developing electrode and thus to prevent contamination by mixing of the various colors. As noted above, the toner collected by collection members 104 is recycled to the corresponding toner reservoirs. A final toner collection member 106 always engages the developer drum 17. The toner collected thereby is supplied to separator 30 (FIG. 1). Alternatively the toner collected by collection member 106 may be supplied directly to the black (K) toner reservoir 46.

It will be appreciated by persons skilled in the art that the present invention is not limited by what has been particularly shown and described hereinabove. Rather the scope of the present invention is defined only by the claims which follow:

We claim:

1. A multicolor electrostatic imaging system comprising:

an imaging surface having an electrostatic image thereon;

a source of liquid toner of a selectable color;

a multiplicity of stationary jet outlets, including a set of jet outlets receiving liquid toner of said selectable color from said source and supplying it directly to said imaging surface, said set of jet outlets being distributed among said multiplicity of jet outlets;

a developer operative to aid in the development of said electrostatic image using said liquid toner to form a developed image; and means for transferring image said developed to a substrate.

2. A system according to claim 1 and wherein each said jet outlet directs a jet of liquid toner in a direction having an upward component.

3. A system according to claim 1 wherein each said jet outlet directs a jet of liquid toner onto a downward facing surface of said imaging surface.

4. A system according to claim 1 and wherein said imaging surface comprises a cylindrical surface.

5. A system according to claim 4 and wherein each said jet outlet directs a jet of liquid toner onto at least part of the lower half of said cylindrical surface.

6. A system according to claim 1 and wherein said multiplicity of jet outlets comprise a linear array of jet outlets.

7. A system according to claim 1 and wherein said multiplicity of outlets include a plurality of said sets, each said set supplying liquid toner of a different color, the elements of each said set being interdigitated with the elements of the other sets.

8. A system according to claim 1 and wherein said developer comprises a rotating cylindrical developing electrode.

9. A system according to claim 1 and wherein said imaging surface moves in a first direction and the surface of said rotating cylindrical developing electrode moves in adjacent spaced relationship thereto in a second direction opposite to said first direction where said developer electrode and said imaging surface are adjacent.

10. A system according to claim 1 wherein said developer comprises a plurality of single color cleaning assemblies, each corresponding to a given one of a plurality of colors.

11. A system according to claim 10 and wherein said developer comprises a final cleaning assembly, downstream of said plurality of cleaning assemblies.

12. A system according to claim 10 and also comprising a single color toner receiving assembly associated with at least one of said single color cleaning assemblies.

13. A system according to claim 12 and also comprising a conduit communicating with said single color toner receiving assembly for recycling said single color toner to said source of liquid toner.

14. A system according to claim 10 and wherein said developer comprises a rotating cylindrical developing electrode and said single color cleaning assemblies include means for selectably engaging said developing electrode.

15. A system according to claim 10 and wherein said cleaning assemblies include scraper blades.

16. A system according to claim 1 and also comprising a squeegee cooperating with said imaging surface downstream of said developing means for removal of excess liquid.

17. A system according to claim 16 wherein said electrostatic image comprises image regions maintained at a first electrical potential and wherein said squeegee is maintained at a voltage having a sign opposite to the sign of said first electrical potential.

18. A system according to claim 16 and wherein said imaging surface moves in a first direction with a first velocity and the surface of said squeegee moves in touching relationship thereto in said first direction at said first velocity.

19. A system according to claim 1 and also comprising a separator for separating toner particles from dispersant.

20. A system according to claim 19 and wherein said separator receives toner from at least one of the following sources:

said developer;

means for removing excess liquid from said imaging surface prior to transfer of said developed image from said imaging surface; and means for cleaning said imaging surface after transfer of said developed image from said imaging surface.

21. A system according to claim 20 and also comprising means for supplying clean dispersant produced by said separator to said means for cleaning to aid in removal of residual toner particles from said imaging surface.

22. A system according to claim 1 and wherein said means for transferring comprises an intermediate transfer member which is operative sequentially to receive a plurality of developed images from said imaging surface before transferring them to said substrate.

23. A system according to claim 1 and wherein said multiplicity of stationary jet outlets comprise a manifold formed of a stack of individual outlet defining members, which stack defines separate toner supply conduits corresponding to each of a plurality of colors.

24. A system according to claim 23 and wherein said stack also comprises a multiplicity of separator members, each pair of adjacent outlet defining members being separated by a separator member, which seals the outlets defined by adjacent outlet defining members from each other.

25. A system according to claim 23 and wherein said stack comprises a repeating series of outlet defining members corresponding to different colors.

26. A system according to claim 1 and wherein said jet outlets provide a plurality of jets of toner whose cross sectional extent upon impingement on the imaging surface does not significantly exceed the cross sectional extent thereof upon leaving the supply means.

27. A system according to claim 1 wherein each jet outlet supplies a jet of liquid toner having a given cross-sectional extent when it impinges upon said imaging surface and wherein adjacent jet outlets of a given set have a center to center spacing which is greater than the given extent.

28. An electrostatic imaging system comprising:

a) an electrostatic imaging surface having an electrostatic image formed thereon; and b) a set of jet outlets for supplying toner of a given color directly onto said imaging surface, wherein each jet outlet supplies a jet of liquid toner having a given cross-sectional extent when it impinges upon said imaging surface and wherein the areas of impingement of adjacent jets of liquid toner of said given color have a center to center spacing which is greater than the given extent.

29. A system according to claim 28 including a developer operative for developing said electrostatic image to form a developed image.

30. A system according to claim 29 including means for transferring said developed image to a substrate.

* * * * *

UNITED STATES PATENT AND TRADEMARK OFFICE

CERTIFICATE OF CORRECTION

PATENT NO. : 5,557,376

DATED : September 17, 1996

INVENTOR(S) : Benzion LANDA et al.

It is certified that error appears in the above-identified patent and that said Letters Patent is hereby corrected as shown below:

At column 9, line 4, Claim 1, line 9, of the printed patent, "operative to aid in the development of" should be ---systems which develops---.

At column 9, line 7, Claim 1, line 12, of the printed patent, "image said developed" should be ---said developed image---.

At column 9, line 29, Claim 8, line 2, of the printed patent, ---system--- should be inserted after "developer".

At column 9, line 37, Claim 10, line 1, of the printed patent, ---system--- should be inserted after "developer".

At column 9, line 41, Claim 11, line 2, of the printed patent, ---system--- should be inserted after "developer".

At column 9, line 51, Claim 14, line 2, of the printed patent, ---system--- should be inserted after "developer".

UNITED STATES PATENT AND TRADEMARK OFFICE

CERTIFICATE OF CORRECTION

PATENT NO. : 5,557,376

DATED : September 17, 1996

INVENTOR(S) : Benzion LANDA et al.

It is certified that error appears in the above-identified patent and that said Letters Patent is hereby corrected as shown below:

At column 9, line 58, Claim 16, line 3, "developing means" should be ---developer system ---.

At column 10, line 9, Claim 20, line 4, of the printed patent, ---system--- should be inserted after "developer".

At column 10, line 40, Claim 26, line 2, of the printed patent, ---, each of--- should be inserted after "toner".

At column 10, line 43, Claim 26, line 5, of the printed patent, "the supply means" should be ---its jet outlet---.

Signed and Sealed this

First Day of September, 1998

Bruce Lehman

*Attest:*

BRUCE LEHMAN

*Attesting Officer*

*Commissioner of Patents and Trademarks*